US011781744B1

(12) United States Patent
Yang

(10) Patent No.: US 11,781,744 B1
(45) Date of Patent: Oct. 10, 2023

(54) LIGHT STRING ASSEMBLY WITH WIRE HOLES

(71) Applicant: Ping Yang, Dongguan (CN)

(72) Inventor: Ping Yang, Dongguan (CN)

( * ) Notice: Subject to any disclaimer, the term of this patent is extended or adjusted under 35 U.S.C. 154(b) by 0 days.

(21) Appl. No.: 18/071,522

(22) Filed: Nov. 29, 2022

(51) Int. Cl.

| | |
|---|---|
| ***F21S 4/10*** | (2016.01) |
| ***F21Y 115/10*** | (2016.01) |
| ***F21V 23/00*** | (2015.01) |
| ***F21V 19/00*** | (2006.01) |
| ***F21V 23/06*** | (2006.01) |

(52) U.S. Cl.
CPC ..... *F21V 23/002* (2013.01); *F21S 4/10* (2016.01); *F21V 19/0015* (2013.01); *F21V 23/06* (2013.01); *F21Y 2115/10* (2016.08)

(58) Field of Classification Search
CPC ..... F21S 4/10
See application file for complete search history.

(56) References Cited

U.S. PATENT DOCUMENTS 5,184,890 A * 2/1993 Chen ..... A47G 33/0836 362/438
7,422,489 B1 * 9/2008 Tseng ..... F21V 21/002 439/699.2
2009/0010000 A1 * 1/2009 Huang ..... H01R 13/7033 362/249.01
2009/0251923 A1 * 10/2009 Yu ..... F21V 31/005 362/653
2012/0127707 A1 * 5/2012 Stoneham ..... F21V 29/71 363/126
2012/0268938 A1 * 10/2012 Peng ..... F21S 4/10 362/249.06
2013/0078847 A1 * 3/2013 Chen ..... F21V 19/0025 439/620.02

FOREIGN PATENT DOCUMENTS

TW M412302 A 9/2011
TW M521697 5/2016

* cited by examiner

*Primary Examiner* — Eric T Eide
(74) *Attorney, Agent, or Firm* — Bradley J. Thorson; DeWitt LLP

(57) ABSTRACT

A light string assembly with wire holes include a light string and multiple bulb shells. The light string includes a wire and multiple bulbs. The bulbs are evenly distributed along the wire and are electrically connected to the wire. One end of the light string is provided with a plug for electrically connecting to the wire. Each bulb shell includes a light holder and a light shade. The light holder and the light shade are detachable and can be connected to each other. Both sides of the light holder each are provided with a respective wire hole. Each light shade encloses a respective one of the multiple bulbs. The wire respectively protrudes from the bulb shells through the two wire holes of each bulb.

8 Claims, 10 Drawing Sheets

LIGHT STRING ASSEMBLY WITH WIRE HOLES

BACKGROUND OF THE INVENTION

1. Field of the Invention

The present application relates to light bulbs, and particularly to a light string assembly with wire holes.

2. Description of Related Art

With the development of society, lights are not only used as decoration of festivals such as Christmas, but are more commonly used in indoor decoration, lighting engineering and various entertainment venues. Compared with the traditional incandescent light, the LED light has incomparable advantages. The LED light not only can realize diverse color changes, but also can effectively reduce the energy consumption.

Copper wire lights are formed by soldering surface mount design (SMD) LEDs and chips on two or more wires. The copper wire light has high production efficiency, and the production process consumes less labor. However, the copper wire light is not aesthetically appealing in appearance, and the bulbs are exposed and easily damaged. The traditional lights need to open the coating to put in a terminal, which not only has low production efficiency, but also increases labor and production costs.

Therefore, it is necessary to provide a solution to solve the above problems.

SUMMARY OF THE INVENTION

The present invention provides a light string assembly with wire holes, which is to solve the problem that the traditional lights have low production efficiency and require a lot of labor and production cost.

The light string assembly with wire holes, comprises:

a light string, comprising:

a wire; and multiple bulbs, evenly distributed along the wire and electrically connected to the wire;

wherein one end of the light string is provided with a plug for electrically connecting to the wire;

multiple bulb shells, each bulb shell comprising:

a light holder, both sides of the light holder each forming a respective wire hole and provided with a respective perforation inside; and a light shade, enclosing the bulb shell;

wherein, the light holder and the light shade are detachable and can be connected to each other;

wherein, the wire respectively protrudes from the bulb shells through the two wire holes of the respective one of the multiple bulbs;

wherein, a clamping plate is installed on a side of the light holder away from the light shade; the clamping plate has a positioning holder mounted in the perforation; and one end of the positioning holder is in contact with the respective one of the multiple bulbs.

More specifically, the positioning holder is provided with a positioning groove on a side away from the clamping plate; both sides of the positioning groove are each provided with a respective opening; each positioning groove is configured to receive the respective one of the multiple bulbs, and the wire on both sides of each bulb is received in the two openings of the positioning groove.

More specifically, at least one of the wire holes is provided with a pressing block; the surface of the pressing block and the surface of said at least one of the wire holes are in close contact with the wire.

More specifically, the pressing block is integrally formed with the clamping plate; the light holder is provided with a slideway on a side away from the light shade; the slideway is connected to the respective one of the wire holes; the pressing block is located in the slideway.

More specifically, the light holder is provided with at least two spacers protruding from the perforation; the clamping plate is provided with hooks at a position corresponding to the spacers; the clamping plate is in contact with one end of the spacers, and the hooks are clamped with the other end of the spacers.

More specifically, the clamping plate is provided with a flexible clamp, and one end of the flexible clamp away from the clamping plate is in contact with the outer surface of the light holder.

More specifically, the light shade is provided with a plurality of refraction grooves caved inward.

More specifically, the bulbs include surface mount design (SMD) LEDs and a potting compound; the SMD LEDs are electrically connected to the wire, and the potting compound is coated on the SMD LEDs.

More specifically, the wire is provided with several mounting areas arranged along the axial direction of the wire, and the SMD LEDs are welded on the mounting areas.

In the present invention, the light string assembly is made of copper wire or leather wire, and the bulbs are directly welded to the wire. This design of the present invention facilitates automated production. Each bulb shell encloses the respective one of the multiple bulbs, and the wire is connected to several bulb shells through the wire holes to form the light string assembly. The above design makes the bulb shells protective and decorative. There is no need to open the coating of the wire to connect a terminal on the wire, which improves the production efficiency of the light string and reduces the overall production cost.

DETAILED DESCRIPTION OF PREFERRED EMBODIMENT(S)

In order to make the objectives, technical solution and advantages of the present invention clearer, the present invention will be further described in detail below with reference to the drawings and embodiments.

The specific embodiments described herein are only used to explain the present invention, but not to limit the present invention.

When an element is referred to as being "fixed to" or "disposed to" other elements, it can be mounted directly on the other elements or through an intervening element.

When an element is referred to as being "connected to" other elements, it can be directly connected to the other elements or through intervening elements.

In addition, "first" and "second" are only used for description, and cannot be regarded as indicating or implying relative importance or implying the number of technical features.

Thus, a feature defined as "first" or "second" may expressly or implicitly include one or more of the features.

In the description of the present invention, "plurality" means two or more, unless otherwise expressly and specifically defined.

In the description of the present invention, the orientation or positional relationship such as "up", "down", "front", "rear", "left", "right", "top", "bottom", "inside", "outside" is based on the orientation or position shown in the accompanying drawings. It is for convenience of description only and does not indicate or imply that a device or element must have a particular orientation. Therefore, it cannot be regarded as a limitation to the present invention.

Figure 1A:
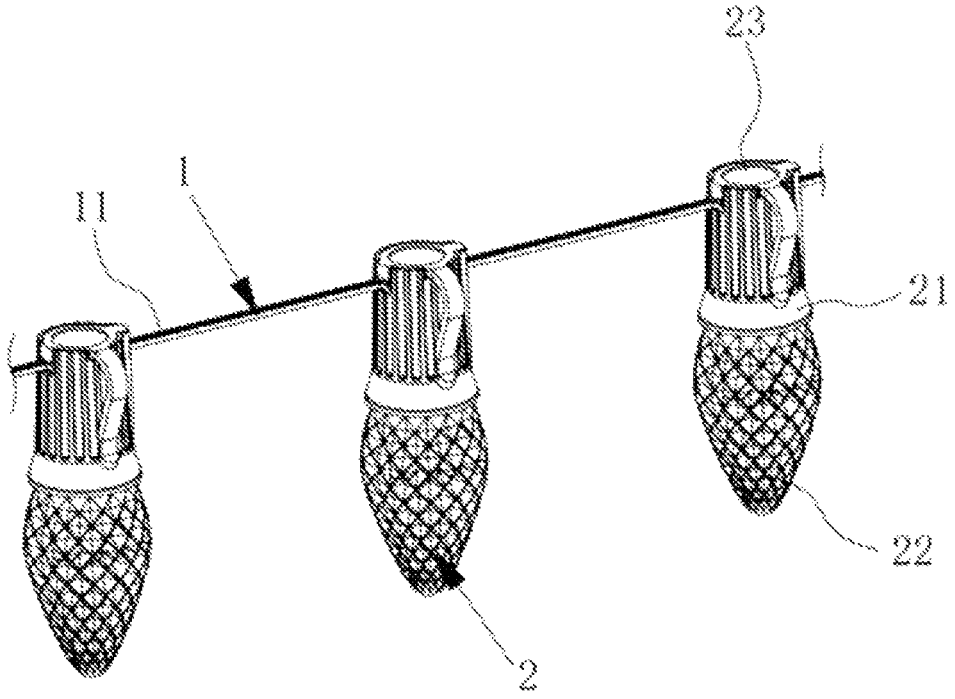
FIG. 1A is a perspective view of the light string assembly with wire holes of the present invention.
Figure 1B:
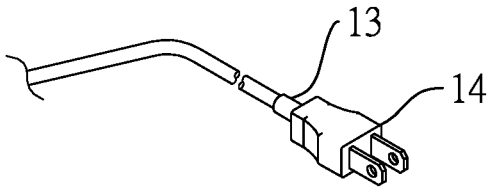
FIG. 1B is a perspective view of a plug of the present invention.
Figure 2:
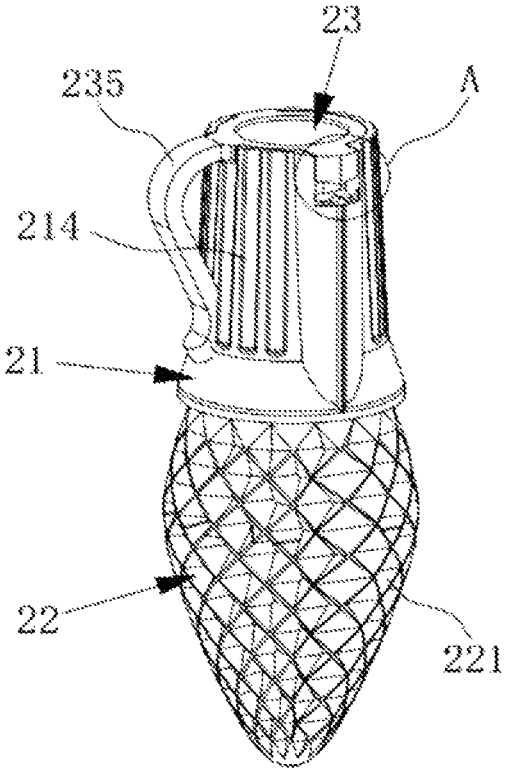
FIG. 2 is a schematic diagram of the bulb shells of the light string assembly with wire holes of the present invention.
Figure 3:
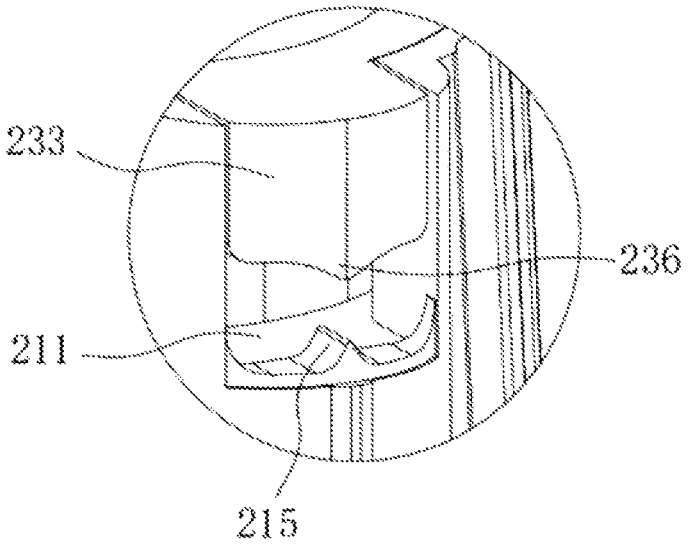
FIG. 3 is the enlarged view of area A in FIG. 2.
Figure 4:
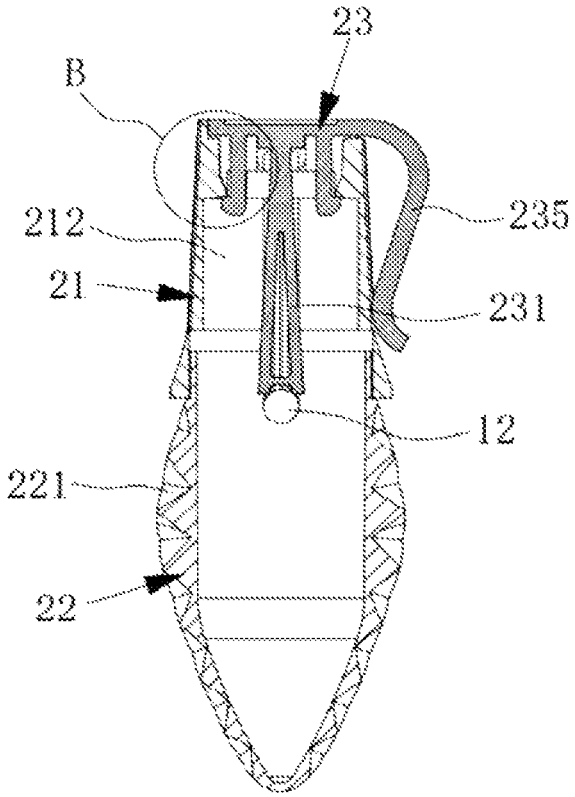
FIG. 4 is a sectional view of the light string assembly with wire holes of the present invention.
Figure 5:
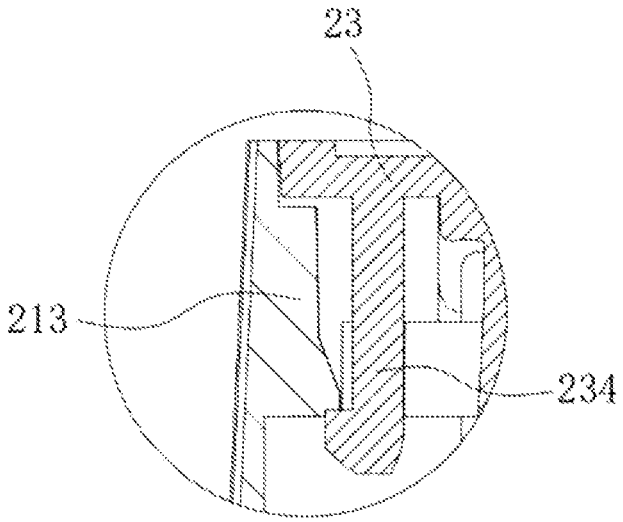
FIG. 5 is the enlarged view of area B in FIG. 4.
Figure 6:
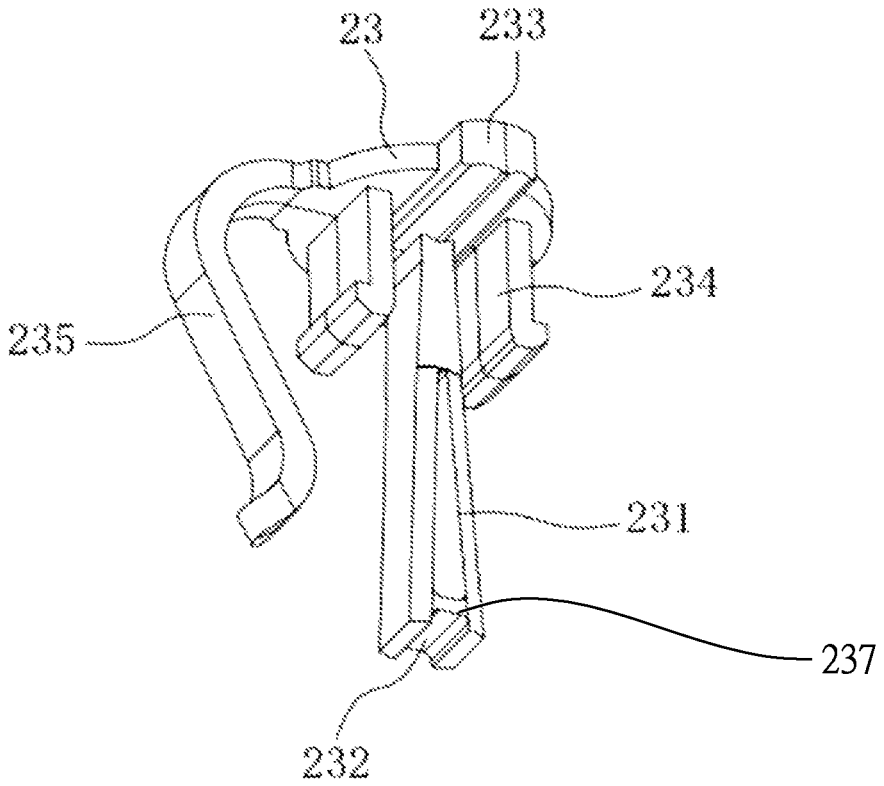
FIG. 6 is a perspective view of the clamping plate of the light string assembly with wire holes of the present invention.
Figure 7:
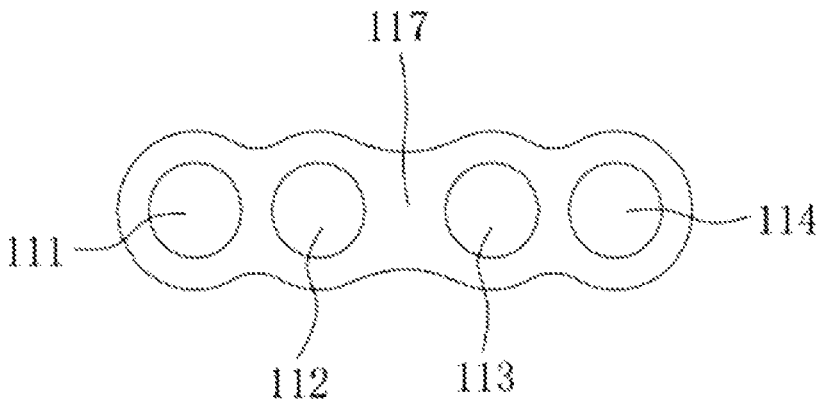
FIG. 7 is a sectional view of a wire of the light string assembly with wire holes of the present invention.
Figure 8:
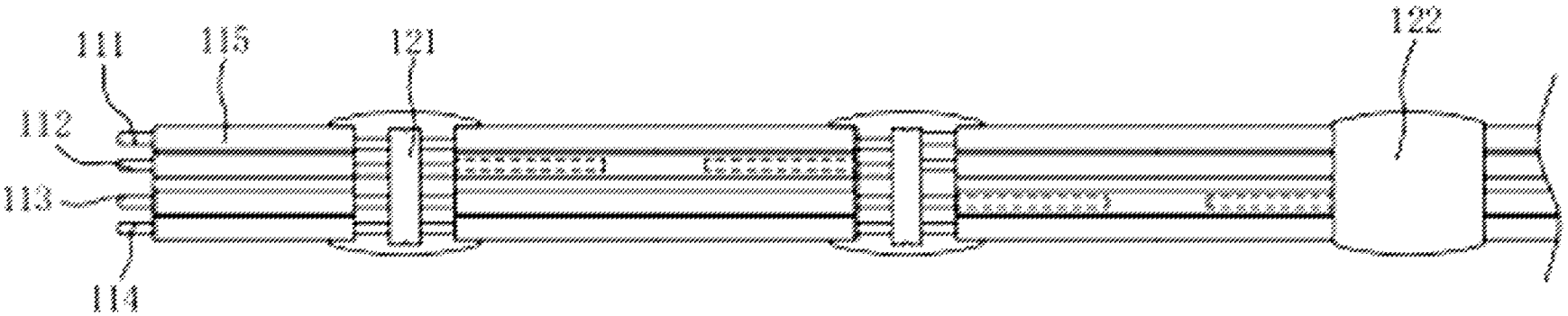
FIG. 8 is a schematic view of the wire of the light string assembly with wire holes of the present invention.
Figure 9:
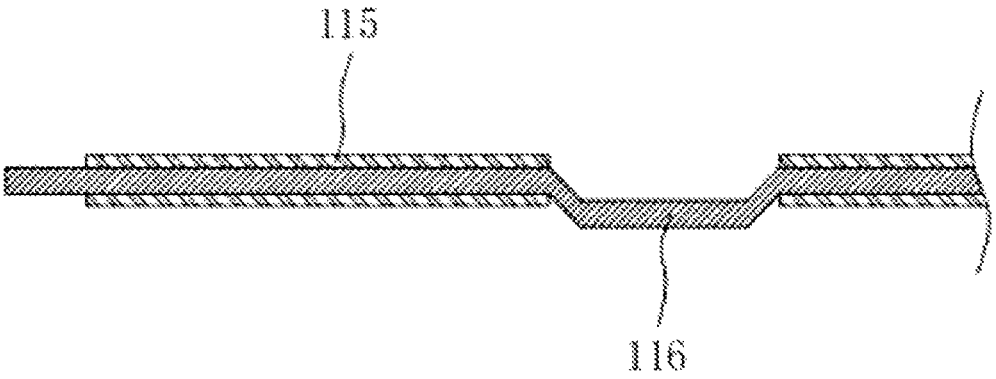
FIG. 9 is a schematic view of a mounting area of the light string assembly with wire holes of the present invention.

With reference to FIG. 1A to FIG. 9, the present invention is a light string assembly with wire holes. The light string assembly comprises a light string 1 and multiple bulb shells 2.

The light string 1 includes a wire 11 and multiple bulbs 12. The bulbs are evenly distributed along the wire 11 and are electrically connected to the wire 11. One end 13 of the light string 1 is provided with a plug 14 for electrically connecting to the wire 11.

Each bulb shell 2 includes a light holder 21 and a light shade 22. The light holder 21 and the light shade 22 are detachable and can be connected to each other. Both sides of the light holder 21 are each provided with a respective wire hole 211. Each light shade 22 encloses a respective one of the bulbs 12. The wire 11 respectively protrudes from the bulb shells 2 through the two wire holes 111 of each bulb 12.

In this embodiment, the light string 1 is made of copper wire or leather wire, and the bulbs 12 are directly welded to the wire 11. This design facilitates automated production. Each bulb shell 2 encloses a respective one of the multiple bulbs 12, and the wire 11 is connected to several bulb shells 2 through the wire holes 211 to form the light string 1. The above design makes the bulb shells 2 protective and decorative. There is no need to open the coating of the wire 11 to connect a terminal on the wire 11, which improves the production efficiency of the light string and reduces the overall production cost.

As the preferred solution of this embodiment, inside of the light holder 21 is provided with a perforation 212. A clamping plate 23 is installed on a side of the light holder 21 which is away from the light shade 22. The clamping plate 23 is provided with a positioning holder 231 mounted in the perforation 212. One end of the positioning holder 231 is in contact with the bulb 12.

The positioning holder 231 prevents the light generated by the bulb 12 from being blocked by the light holder 21 and causing shadows, which helps to reduce light loss, improve the brightness of the bulb 12 and enhance the aesthetic effect.

As the preferred solution of this embodiment, the positioning holder 231 is provided with a positioning groove 232 on a side away from the clamping plate 23. Both sides of the positioning groove 232 are each provided with a respective opening 237. The bulb 12 is accommodated in the positioning groove 232, and the wire 11 on both sides of the bulb 12 is received in the two openings 237. The positioning groove 232 plays a positioning role for the bulb 12 to prevent the bulb 12 from being separated from the positioning holder 231 and improve the connection stability of the positioning holder 231 and the bulbs 12. The light generated by the bulbs 12 is prevented from being blocked by the positioning holder 231 and causing shadows.

As the preferred solution of this embodiment, a reflector is installed at one end of the light shade 22 closer to the light holder 21, and a via hole is formed on the reflector. When the light shade 22 is mounted on the light holder 21, the positioning holder 231 penetrates through the via hole, and the bulb 12 is placed inside the light shade 22. The light emitted from the bulb 12 to a side close to the light holder 21 can be reflected by the reflector to improve the utilization of the light, thereby improving the brightness of the light string 1.

As the preferred solution of this embodiment, at least one of the wire holes 211 is provided with a pressing block 233. The surface of the pressing block 233 and the surface of a respective one of the wire holes 211 are in close contact with the wire 11. After the wire 11 is mounted through the wire holes 211, the pressing block 233 is installed in the respective one of the wire holes 211, so that the pressing block 233 can cooperate with the surface of the respective one of the wire holes 211 to clamp the wire 11. The above design is used to fix the wire 11 and the bulb shells 2 and avoid the relative sliding of the wire 11 and the bulb shells 2, thereby preventing the position of the bulbs 12 from shifting, which affects the lighting of the bulbs 12.

As the preferred solution of this embodiment, after the wire 11 is inserted into the wire holes 211, the pressing block 233 can be fixed on the light holder 21 by clipping, bonding, etc.

As the preferred solution of this embodiment, the pressing block 233 is integrally formed with the clamping plate 23. The light holder 21 is provided with a slideway on a side away from the light shade 22. The slideway is connected to the wire holes 211. The pressing block 233 is located in the slideway.

When the clamping plate 23 is installed in the perforation 212, the pressing block 233 slides in the slideway until the wire 11 is pressed tightly. As the pressing block 233 is small, the above design facilitates ease of the installation of the pressing block 233. Secondly, the pressing block 233 can also serve as a fool-proof part while pressing the wire 11. When the clamping plate 23 is placed in the perforation 212, the openings 237 on both sides of the positioning groove 232 are located on the same plane with the two wire holes 211. The wire 11 is prevented from being wound inside the light holder 21 to cause breakage.

As the preferred solution of this embodiment, the light holder 21 is provided with at least two spacers 213 protruding from the perforation 212. The clamping plate 23 is provided with hooks 234 corresponding in position to the spacers 213. The clamping plate 23 is in contact with one end of the spacers 213, and the hooks 234 are clamped with the other end of the spacers 213.

When the clamping plate 23 is installed, the hooks 234 are in contact with the spacers 213 and is elastically deformed, so that the clamping plate 23 can continue to descend. When the clamping plate 23 is in contact with one end of the spacers 213, the hooks 234 restore to the state before the deformation. The hooks 234 are in contact with the other end of the spacers 213, and the clamping plate 23 is fixedly connected to the light holder 21.

As the preferred solution of this embodiment, the clamping plate 23 is provided with a flexible clamp 235, and one end of the flexible clamp 235 away from the clamping plate 23 is in contact with the outer surface of the light holder 21. Through the design of the flexible clamp 235, the bulb shell 2 can be conveniently installed at various decorative positions, thereby improving the aesthetic effect.

As the preferred solution of this embodiment, the flexible clamp 235 is arc-shaped, and a gap is formed between the middle of the flexible clamp 235 and the light holder 21. The above design not only connects the bulb shells 2 in series by passing the rope through the gaps on the bulb shells 2, but also fixes the bulb shells 2 on the fence, Christmas tree and other components through the clamping between the flexible clamp 235 and the light holder 21. The light string can be installed in a variety of ways and can be used in different scenarios.

As the preferred solution of this embodiment, the light shade 22 is provided with a plurality of refraction grooves 221, and the refraction grooves 221 are formed by caving inward. The design of the refraction grooves 221 enables the light generated by the bulbs 12 to be refracted multiple times when it is emitted outward and makes light intensity in all directions almost the same, thereby improving the uniformity of the light, making the light softer, and avoiding glare.

As the preferred solution of this embodiment, an inner thread extends from the light holder 21 into the perforation 212, and the inner thread is provided on a side close to the light shade 22. The light shade 22 is provided with an external thread that matches the internal thread. During installation, the bulbs 12 are first arranged on the light holders 21, and then the light shades 22 are screwed to the light holders 21. In this embodiment, a number of slip-proof grooves 214 are formed on the outer side of the light holder 21. This design prevents the light holder 21 from slipping when it rotates, so that the light shade 22 can be smoothly installed on the light holder 21.

As the preferred solution of this embodiment, each of the bulbs 12 includes surface mount design (SMD) LEDs 121 and potting compounds 122. The SMD LED 121 is electrically connected to the wire 11, and the potting compound 122 is coated on the SMD LEDs 121. The wire 11 is provided with several mounting areas 116 arranged along the axial direction of the wire 11, and the SMD LEDs 121 are welded on the mounting areas 116.

The SMD LEDs 121 can be connected in series, in parallel or in a combination thereof.

In this embodiment, the SMD LEDs 121 are connected in series. The wire 11 includes a positive wire 111, a first signal wire 112, a second signal wire 113, a negative wire 114, and an insulating layer 115 covering the positive wire 111, the first signal wire 112, the second signal wire 113 and the negative wire 114. Each mounting area 116 includes a positive pad, a first signal pad, a second signal pad and a negative pad. The positive pad is formed on the positive wire 111. The first signal pad is formed on the first signal wire 112. The second signal pad is formed on the second signal wire 113. The negative pad is formed on the negative wire 114. The first signal wire 112 between two adjacent first signal pads and the second signal wire 113 between two adjacent second signal pads are alternately disconnected along the light string. Each SMD LED 121 is provided with a positive welding leg, an input signal welding leg, an output signal welding leg and a negative welding leg. The positive welding leg is welded on the positive pad, and the negative welding leg is welded on the negative pad. The positions of the input signal welding leg correspond to the positions of the output signal welding leg on the two adjacent SMD LEDs 121.

The input signal welding leg on a first SMD LED 121 is welded to the first signal pad, and the output signal welding leg on the first SMD LED121 is welded to the second signal pad. The input signal welding leg on a second SMD LED121 adjacent to the first SMD LED121 is welded to the second signal pad, and the output signal welding leg on the second SMD LED121 adjacent to the first SMD LED121 is welded to the first signal pad.

A positive terminal of the driving power is connected to the positive wire 111, and a negative terminal of the driving power is connected to the negative wire 114. The output of the driving power is connected to the first signal wire 112 or the second signal wire 113. The control signal includes several groups of data, including the first group of data, the second group of data, the third group of data, . . . , and the nth group of data. When the control signal is input to the driver chip of the first SMD LED 121, the driver chip intercepts the first group of data and transmits the remaining data through the first signal wire 112 or the second signal wire 113. The driver chip controls the light-emitting chip of the first SMD LED 121 to work according to the first group of data. The driver chip intercepts the second group of data and transmits the remaining data. The driver chip controls the light-emitting chip of a second SMD LED 121 to work according to the second group of data, and so on, to realize the control of the nth bulb 12.

As the preferred solution of this embodiment, the mounting areas 116 are curved, and two adjacent mounting areas 116 limit the insulating layer 115 to prevent the insulating layer 115 from sliding along the wire 11.

As the preferred solution of this embodiment, a separation layer 117 is disposed between the first signal wire 112 and the second signal wire 113. A first arch block 236 extends from the pressing block 233. A second arch block 215 protrudes from the wire hole 211.

When the clamping plate 23 is installed in the perforation 212, the first arch block 236 and the second arch block 215 squeeze both sides of the separation layer 117 respectively to fix the wire 11. With the design of the separation layer 117, the wire 11 can be fastened to the light holder 21 under the condition that the wire 11 is not damaged by pressure.

With the structure of the present invention, there is no need to open the coating of the wire 11 to connect a terminal on the wire 11. The invention, which improves the production efficiency of the light string and reduces the overall production cost, solves the problems that the traditional lights have low production efficiency and require a lot of labor and production cost.

The above description is only a preferred embodiment of the present invention, and its structure is not limited to the above-mentioned shapes.

What is claimed is:

1. A light string assembly with wire holes, comprising:

a light string, comprising:

a wire; and multiple bulbs, evenly distributed along the wire and electrically connected to the wire;

wherein one end of the light string is provided with a plug for electrically connecting to the wire;

multiple bulb shells, each bulb shell comprising:

a light holder, both sides of the light holder each forming a respective wire hole and provided with a respective perforation inside; and a light shade, enclosing a respective one of the multiple bulbs;

wherein, the light holder and the light shade are detachable and connectable to each other;

wherein, the wire protrudes from the bulb shells through the wire holes of the multiple bulb shells;

wherein, a clamping plate is installed on one of the sides of the light holder that is away from the light shade; the clamping plate has a positioning holder arranged in the perforation and one end of the positioning holder is in contact with the respective one of the multiple bulbs;

wherein the positioning holder is provided with a positioning groove on a side away from the clamping plate; both sides of the positioning groove are each provided with a respective opening; each positioning groove receives the respective one of the multiple bulbs, each bulb is accommodated in the positioning groove, and the wire on both sides of each bulb is placed in the two openings of the positioning groove.

2. The light string assembly as claimed in claim 1 wherein at least one of the wire holes is provided with a pressing block; a surface of the pressing block and a surface of a respective one of the wire holes are in close contact with the wire.

3. The light string assembly as claimed in claim 2 wherein the pressing block is integrally formed with the clamping plate; the light holder is provided with a slideway on a side away from the light shade; the slideway is connected to the respective one of the wire holes; and the pressing block is mounted in the slideway.

4. The light string assembly as claimed in claim 1 wherein the light holder is provided with at least two spacers protruding from the perforation; the clamping plate is provided with hooks corresponding in position to the spacers; the clamping plate is in contact with one end of the spacers, and the hooks are engaged with the other end of the spacers.

5. The light string assembly as claimed in claim 1 wherein the clamping plate is provided with a flexible clamp, and one end of the flexible clamp away from the clamping plate is in contact with an outer surface of the light holder.

6. The light string assembly as claimed in claim 1 wherein the light shade is provided with a plurality of refraction grooves caved inward.

7. The light string assembly as claimed in claim 1, the bulbs each comprising:

multiple surface mount design (SMD) LEDs, electrically connected to the wire; and a potting compound, coated on the SMD LEDs.

8. The light string assembly as claimed in claim 7 wherein the wire is provided with several mounting areas arranged along an axial direction of the wire, and the SMD LEDs are welded on the mounting areas.

* * * * *